US005984976A

United States Patent [19]

Fuso

[11] Patent Number: 5,984,976

[45] Date of Patent: Nov. 16, 1999

[54] PROCESS FOR IMPROVING THE PHOTOCHEMICAL STABILITY OF DYEINGS AND PRINTS ON POLYESTER FIBRES

[75] Inventor: Francesco Fuso, Therwil, Switzerland

[73] Assignee: Ciba Specialty Chemicals Corporation, Tarrytown, N.Y.

[21] Appl. No.: 09/038,389

[22] Filed: Mar. 11, 1998

[30] Foreign Application Priority Data

Mar. 11, 1997 [CH] Switzerland ..... 583/97

[51] Int. Cl.[6] ..... D06P 5/00; D06P 5/02; D06M 13/322

[52] U.S. Cl. ..... 8/442; 8/566; 8/688; 8/190; 8/922; 8/490; 8/115.59

[58] Field of Search ..... 8/442, 566, 688, 8/190, 922, 490, 115.59

[56] References Cited

U.S. PATENT DOCUMENTS

| | | | |
|---|---|---|---|
| 3,896,125 | 7/1975 | Helmo et al. | 260/249.5 |
| 4,831,068 | 5/1989 | Reinert et al. | 524/100 |
| 5,298,030 | 3/1994 | Burdeska et al. | 8/442 |
| 5,575,958 | 11/1996 | Jöllenbeck et al. | 252/589 |

*Primary Examiner*—Yogendra Gupta
*Assistant Examiner*—Brian P. Mruk
*Attorney, Agent, or Firm*—Kevin T. Mansfield

[57] ABSTRACT

A process for the photochemical stabilization of dyeings and prints on polyester fibre material, which comprises treating the polyester fibre material with a compound of formula (1)

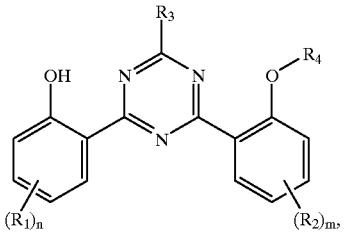

wherein $R_1$, $R_2$, $R_3$, $R_4$, n and m are as defined herein.

The treated dyed or printed polyester fibre material is distinguished by good fastness to light and heat and has a high sun protection factor.

12 Claims, No Drawings

PROCESS FOR IMPROVING THE PHOTOCHEMICAL STABILITY OF DYEINGS AND PRINTS ON POLYESTER FIBRES

The present invention relates to a process for the photochemical and thermal stabilisation of dyeings and prints on polyester fibre materials and polyester-containing mixed fibres.

Dyed or printed polyester fibre material can be damaged by the effect of light and, in particular, by the simultaneous action of heat. For use in the automobile sector it is imperative to protect these dyed fibre materials effectively against, for example, UV radiation.

Light stabilisers for polyester fibre materials based on triazine are known. However, the protective effect of these compounds does not entirely meet today's requirements, in particular in the automobile sector. There is therefore still a need for a better protection of these dyeings and prints.

It has now been found that a very good protection of dyeings and prints on polyester materials may be obtained using specific 2-(2'-hydroxyphenyl)-s-triazine derivatives.

Accordingly, this invention relates to a process for the photochemical stabilisation of dyeings and prints on polyester fibre material, which comprises treating the polyester fibre material with a compound of formula (1)

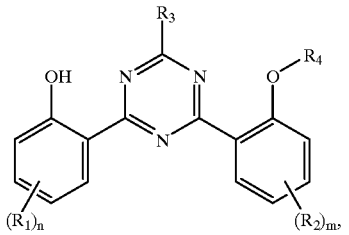

wherein $R_1$ and $R_2$ are each independently of the other hydrogen; $C_1$–$C_4$alkyl; $C_1$–$C_4$alkoxy, halogen, allyloxy or benzyloxy, $R_3$ is unsubstituted or $C_1$–$C_4$alkoxy-substituted $C_1$–$C_4$alkyl, $R_4$ is hydrogen, unsubstituted or phenyl-substituted $C_1$–$C_4$alkyl or allyl, and n and m are each independently of the other 1, 2 or 3.

$R_1$, $R_2$, $R_3$ and $R_4$ defined as $C_1$–$C_4$alkyl are methyl, ethyl, propyl, i-propyl, n-butyl, sec-butyl, i-butyl or tert-butyl.

$R_1$ and $R_2$ and the alkoxy-substituted part of $R_3$ defined as $C_1$–$C_4$alkoxy are typically methoxy, ethoxy, propoxy, i-propoxy or butoxy.

Phenyl as a substituent in $R_4$, and the phenyl radicals in benzyloxy as substituents in $R_1$ and $R_2$, can be mono- or polysubstituted by $C_1$–$C_4$alkyl, $C_1$–$C_4$alkoxy or halogen.

For the novel process it is preferred to use compounds of formula (1), wherein $R_1$ and $R_2$ are each independently of the other hydrogen or $C_1$–$C_4$alkoxy.

Other preferred compounds for the novel process are those of formula (1), wherein $R_3$ is methyl, ethyl or n-butyl.

Those compounds of formula (1), wherein n is 2 and, preferably, 1, are also preferably used in the novel process.

Other preferred compounds for the novel process are compounds of formula (1), wherein m is 1.

Particularly preferred compounds for the novel process are those of formula (1), wherein $R_1$ and $R_2$ are each independently of the other $C_1$–$C_4$alkoxy in position 4 on the phenyl ring.

Other particularly preferred compounds for the novel process are those of formula (1), wherein $R_3$ is methyl or n-butyl.

Other particularly preferred compounds for the novel process are those of formula (1), wherein $R_4$ is hydrogen.

Very particularly preferred compounds for the novel process are those of formula (1), wherein $R_1$ is 4-methoxy and $R_2$ is 4-methoxy.

The compounds of formula (1) are known, inter alia, from U.S. Pat. No. 3,896,125 or can be prepared by known methods.

The compounds used according to this invention are used in an amount of 0.01 to 5% by weight, preferably of 0.1 to 3% by weight, based on the weight of the fibre material.

The compounds used according to this invention are sparingly soluble in water and are therefore usefully applied in dispersed form. For this purpose they are ground to a particle size of 1–2 mm with a corresponding dispersant using e.g. quartz balls and a high-speed agitator.

Suitable dispersants for the compounds of formula (1) are for example:

acid esters or their salts of alkylene oxide adducts, for example acid esters or their salts of a polyadduct of 4 to 40 mol of ethylene oxide with 1 mol of phenol, or phosphates of the adducts of 6 to 30 mol of ethylene oxide with 1 mol of 4-nonylphenol, 1 mol of dinonylphenol or, in particular, with 1 mol of compounds which are prepared by addition of 1 to 3 mol of unsubstituted or substituted styrenes to 1 mol of phenol, polystyrene sulfonates, fatty acid taurides, alkylated diphenyl oxide monosulfonates or diphenyl oxide disulfonates, sulfonates of polycarboxylates, addition products of 1 to 60, preferably of 2 to 30 mol, of ethylene oxide and/or propylene oxide with fatty amines, fatty amides, fatty acids or fatty alcohols containing 8 to 22 carbon atoms each or with tri- to hexa-valent alkanols containing 3 to 6 carbon atoms, which addition products have been converted to an acid ester with an organic dicarboxylic acid or an inorganic polyacid, lignin sulfonates and, in particular, formaldehyde condensates, for example condensates of lignin sulfonates and/or phenol and formaldehyde, condensates of formaldehyde with aromatic sulfonic acids, for example condensates of ditolyl ether sulfonates and formaldehyde, condensates of naphthalene sulfonic acid and/or naphthol- or naphthylaminosulfonic acids with formaldehyde, condensates of phenolsulfonic acids and/or sulfonated dihydroxydiphenylsulfone and phenols or cresols with formaldehyde and/or urea, and also condensates of diphenyl oxide disulfonic acid derivatives with formaldehyde.

Suitable dyes are disperse dyes which are only sparingly soluble in water. In the dye liquor they are therefore largely present in the form of a fine dispersion. They may be part of different dye classes, for example the acridone, azo, anthraquinone, coumarine, methine, perinone, naphthoquinonimine, quinophthalone, styryl or nitro dyes. In accordance with this invention it is also possible to use mixtures of disperse dyes.

Polyester fibre materials which can be dyed or printed and which are treated with the compounds of formula (1) will be understood as being, for example, cellulose ester fibres, such as cellulose-24-acetate fibres and cellulose-24-triacetate fibres and, in particular, linear polyester fibres which are possibly also acid-modified, which are obtained, for example, by condensation of terephthalic acid with ethylene glycol or of isophthalic or terephthalic acid with 1,4-bis (hydroxymethyl)cyclohexane, and also fibres of copolymers of terephthalic and isophthalic acid and ethylene glycol. The linear polyester fibre material (PES) which is as yet almost exclusively used in the industry consists of terephthalic acid and ethylene glycol.

The fibre materials can also be used as blends with each other or with other fibres, for example blends of polyacrylonitrile/polyester, polyamide/polyester, polyester/cotton, polyester/viscose and polyester/wool, and can be dyed or also printed by known batchwise or continuous processes.

The polyester fibre material can be in different forms of presentation. Suitable materials are usefully piece goods, such as knitgoods, bonded fibre fabrics or wovens, or also yarn on cheeses, warp beams, and the like.

Also very suitable for the novel process are polyester textile fabrics and textile blends comprising polyester fibres used for the outerwear garment sector and which are transparent. If such textiles are treated by the novel process they can protect the skin tissue underneath the transparent outerwear garment fabric from the harmful effect of UV radiation.

The dyeings are carried out from an aqueous liquor by a continuous or batchwise process. In the batchwise process (exhaust process) the liquor ratio can be chosen within a wide range, e.g. from 1:4 to 1:100, preferably from 1:6 to 1:50. The dyeing temperature is at least 50° C. and is usually not above 140° C. The preferred dyeing temperature is in the range from 80 to 135° C.

In continuous dyeing processes, the dye liquors, which can contain additional auxiliaries besides the dyes, are applied to the piece goods e.g. by pad-dyeing or slop-padding and are developed by thermofixation or HT-steam processes.

Linear polyester fibres and cellulose fibres are preferably dyed by the so-called high-temperature method in closed and pressure-resistant apparatus at temperatures of >100° C., preferably in the range from 110° to 35° C. and, if appropriate, under pressure. Suitable closed vessels are, for example, circulation apparatus, such as cheese dyeing or beam dyeing apparatus, winch becks, jet dyeing or drum dyeing machines, muff dyeing apparatus, paddles or jiggers.

Cellulose-24-acetate fibres are preferably dyed at temperatures from 80–85° C. If the novel UV absorbers are used in the dyeing application, then application is carried out by treating the fibre material first with these compounds and then dyeing it or, preferably, by treating the fibre material simultaneously with the UV absorber and the dye in the dye liquor. However, it is also possible to apply the UV absorber later to the finished dyeing by thermofixation, e.g. at 190 to 230° C. over a period of 30 seconds to 5 minutes.

The dye liquors can also comprise further additives, such as dyeing auxiliaries, dispersants, carriers, wool protecting and wetting agents as well as antifoams.

The dye baths can also contain mineral acids, for example sulfuric acid or phosphoric acid, or usefully organic acids, for example aliphatic carboxylic acids, such as formic acid, acetic acid, oxalic acid or citric acid and/or salts, e.g. ammonium acetate, ammonium sulfate or sodium acetate. The acids serve principally to adjust the pH of the liquors used according to this invention, which is preferably from 4 to 5.

The fibre material is preferably run in the bath for 5 minutes at 40 to 80° C., which bath comprises the dye, the UV absorber and, where appropriate, further additives and which is adjusted to a pH of 4.5 to 5.5, and the temperature is then raised over 10 to 20 minutes to 125 to 130° C. and the fibre material is further treated for 15 to 90 minutes, preferably for 30 minutes, at this temperature.

The dyeings are finished by cooling the dye liquor to 50 to 80° C., rinsing the dyeings with water and, if desired, purifying them in customary manner in alkaline medium under reductive conditions. The dyeings are then rinsed again and dried. If vat dyes are used for the cellulose component, the goods are treated in customary manner first with hydrosulfite at a pH of 6 to 12.5, then with an oxidant and are then rinsed out.

To produce prints, the UV absorbers used according to this invention are conveniently admixed in the form of their aqueous dispersions to the printing pastes. The printing paste in this case contains the corresponding UV absorber in amounts of 0.01 to 5%, preferably of 0.1 to 3% by weight, based on the weight of the printing paste. However, it is also possible to apply the UV absorbers already when preparing the material for printing, e.g. by the thermofixation method.

The amount of the dyes which are added to the printing pastes depends on the desired shade; amounts of 0.01 to 15, preferably of 0.02 to 10% by weight, based on the textile material used, have generally been found to be useful.

In addition to the dyes and the aqueous UV absorber dispersion, the printing pastes usefully contain acid-stable thickeners, preferably of natural origin, such as plant seed gum derivatives, in particular sodium alginate, by themselves or in admixture with modified cellulose, in particular with preferably 20 to 25% by weight of carboxymethyl cellulose. In addition, the printing pastes can also contain acid donors, such as butyrolactone or sodium hydrogen phosphate, preservatives, sequestrants, emulsifiers, water-insoluble solvents, oxidants or deaerators.

Suitable preservatives are in particular formaldehyde-donating agents, such as paraformaldehyde or trioxane, especially aqueous, about 30 to 40% by weight formaldehyde solutions; suitable sequestrants are e.g. sodium nitrilotriacetic acid, sodium ethylenediaminetetracetic acid, especially sodium polymetaphosphate, in particular sodium hexametaphosphate; suitable emulsifiers are especially adducts of alkylene oxide and fatty alcohol, in particular an adduct of oleyl alcohol and ethylene oxide; suitable water-insoluble solvents are high-boiling saturated hydrocarbons, especially paraffins having a boiling range of about 160 to 210° C. (so-called white spirits); suitable oxidants are e.g. an aromatic nitro compound, especially aromatic mono- or dinitrocarboxylic acid or mono- or dinitrosulfonic acid, which may be in the form of an alkylene oxide adduct, in particular a nitrobenzenesulfonic acid; and suitable deaerators are typically high-boiling solvents, especially turpentine oils, higher alcohols, preferably $C_8$- to $C_{10}$alcohols, terpene alcohols or deaerators based on mineral and/or silicone oils, in particular commercial formulations consisting of about 15 to 25% by weight of a mixture of mineral and silicone oil and about 75 to 85% by weight of a $C_8$ alcohol such as 2-ethyl-n-hexanol.

When printing the fibre material, the printing paste is applied direct over the entire fibre material or only on parts thereof, convenient printing machines being those of conventional build, e.g. rotogravure, rotary screen printing, flat screen printing or ink jet machines.

After being printed, the fibre material is dried at a temperature of up to 150° C., preferably in the range from 80° to 120° C.

Fixation of the material is then carried out by heat treatment in the temperature range from preferably 100° to 220° C. The heat treatment is usually carried out in superheated steam under pressure.

Depending on the temperature, the fixation can be carried out in 20 seconds to 12 minutes, preferably in 4 to 8 minutes.

The prints are also finished in conventional manner by rinsing with water and can also be carried out, if appropriate, by additional purification in alkaline medium under reductive conditions e.g with sodium dithionite. In the latter case, the prints are rinsed again and are then removed from the water and dried.

With the novel process it is possible to obtain polyester dyeings and prints which are highly lightfast and resistant to sublimation. The novel process does not require a selective pre- or aftertreatment of the fibre materials.

The polyester fibre materials treated with the novel process are also distinguished by a very high sun protection factor.

This invention therefore also relates to the use of the compounds of formula (1) for increasing the sun protection factor of dyed or printed polyester fibre materials.

The sun protection factor can be determined, for example, by the method described by B. L. Diffey and J. Robson in J. Soc. Cosmet. Chem. 40, 127–133 (May/June 1989).

The following Examples illustrate the invention in more detail. Parts and percentages are by weight and temperatures are given in degrees Celsius. The relationship between parts by weight and parts by volume is the same as that between the gramme and and the cubic centimeter.

EXAMPLE 1

(a) In a laboratory apparatus, equipped with a stirrer, 5 parts by weight of the compound of formula (10)

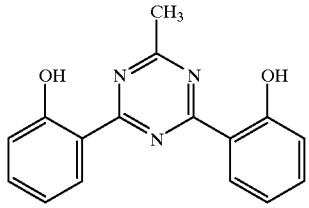

are charged with 2.5 parts by weight of a condensate of naphthalenesulfonic acid and formaldehyde as dispersant, which is dissolved in 15 ml of water, and with 25 parts by weight of quartz beads and this mixture is ground at about 1600 rpm until a particle size of less than 2 $\mu$m is obtained. The dispersion is then separated from the quartz beads. By adding water, the content of the compound of formula (10) is adjusted to 10% by weight, based on the formulation.

(b) One piece of 10 g polyester tricot is dyed in a high-temperature dyeing apparatus (Turbomat®, of Mathis, Niederhasli, CH) at a liquor ratio of 1:10. The aqueous dye liquor contains per 1 l of liquor 2 g of ammonium sulfate, 0.5 g of a commercially available levelling agent, 0.5 g of the formulation prepared under (a) of the compound of formula (10), 0.83 g of a dye mixture containing 0.28 g of the dye of formula (50)

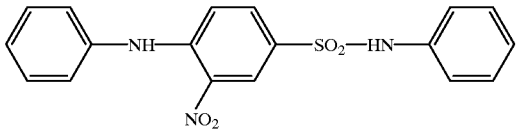

0.26 g of the dye of formula (51)

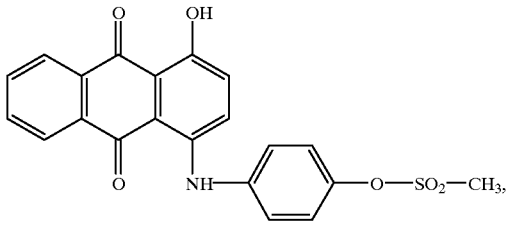

0.16 g of the dye of formula (52)

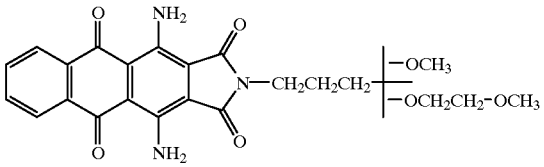

and 0.13 g of the dye of formula (53)

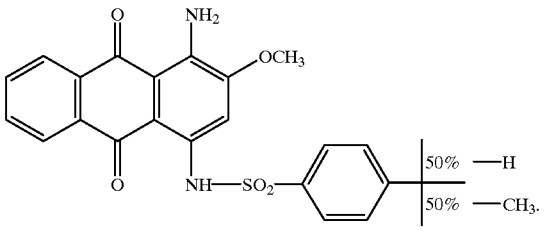

The dye liquor is adjusted to pH 5 with acetic acid and is then homogenised, placed into the high-temperature dyeing apparatus together with the polyester tricot and heated first to 70° C. and then over 30 minutes to 130° C. The polyester tricot is dyed for 60 minutes at this temperature.

The liquor is then cooled to 75° C. and the dyed polyester tricot is rinsed with hot and cold water and subjected to reductive purification by treatment with a liquor containing 3 ml/l of a 30% aqueous solution of NaOH and 2 g/l of sodium dithionite for 20 minutes at 70° C. The polyester tricot piece is then rinsed with warm and cold water, centrifuged and dried at 80° C.

A gray polyester tricot is obtained having good allround fastness properties, in particular very good fastness to hot light.

EXAMPLE 2

(c) The procedure of Example 1 (a) is repeated, but replacing 5 parts by weight of the compound of formula (10) with the same amount of the compound of formula (11)

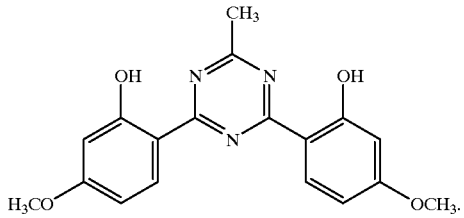

(d) The procedure of Example 1 (b) is repeated, but replacing 0.5 g of the formulation comprising the compound of formula (10) with the same amount of a formulation described under (c) of the compound of formula (11), also giving a gray polyester tricot having good allround fastness properties, in particular very good fastness to hot light.

EXAMPLE 3

(e) The procedure of Example 1 (a) is repeated, but replacing 5 parts by weight of the compound of formula (10) with the same amount of the compound of formula (12)

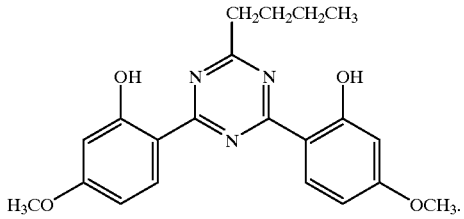

(f) The procedure of Example 1 (b) is repeated, but replacing 0.5 g of the formulation comprising the compound of formula (10) with the same amount of a formulation described under (e) of the compound of formula (12), also giving a gray polyester tricot having good allround fastness properties, in particular very good fastness to hot light.

EXAMPLE 4

Using a dyeing process according to Example 1 and replacing 0.5 g of the compound of formula (10) with 0.5 g each of the compounds listed in the following Table 1 also gives gray polyester tricots having good allround fastness properties, in particular very good fastness to hot light.

TABLE 1

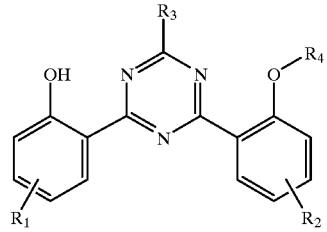

| $R_1$ | $R_2$ | $R_3$ | $R_4$ |
|---|---|---|---|
| H | H | n-butyl | H |
| 4-benzyloxy | 4-benzyloxy | methyl | H |
| 4-allyloxy | 4-allyloxy | methyl | H |
| 3,5-dimethyl | H | i-propyl | methyl |
| 3,5-dimethyl | 5-Cl | ethyl | H |
| 4-methoxy | H | n-butyl | H |
| H | 5-Cl | methyl | H |

What is claimed is:

1. A process for the photochemical stabilisation of dyeings and prints on polyester fibre material, which comprises treating the polyester fibre material with a compound of formula (1)

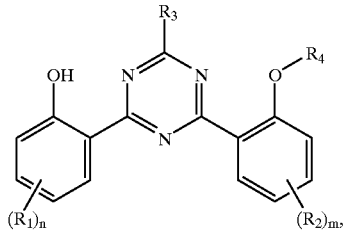

wherein $R_1$ and $R_2$ are each independently of the other hydrogen; $C_1$–$C_4$alkyl; $C_1$–$C_4$alkoxy, halogen, allyloxy or benzyloxy, $R_3$ is $C_1$–$C_4$ alkyl or $C_1$–$C_4$alkoxy-substituted $C_1$–$C_4$alkyl, $R_4$ is hydrogen, unsubstituted or phenyl-substituted $C_1$–$C_4$alkyl or allyl, and n and m are each independently of the other 1, 2 or 3, with the proviso that if $R_1$ is a $C_1$–$C_4$ alkyl, $C_1$–$C_4$ alkoxy or a halogen, then $R_2$ and $R_4$ cannot simultaneously be hydrogen.

2. A process according to claim 1, which comprises treating the polyester fibre material with a compound of formula (1), wherein $R_1$ and $R_2$ are each independently of the other hydrogen or $C_1$–$C_4$alkoxy.

3. A process according to claim 2, which comprises treating the polyester fibre material with a compound of formula (1), wherein $R_1$ and $R_2$ are each independently of the other $C_1$–$C_4$alkoxy in position 4 on the phenyl ring.

4. A process according to claim 3, which comprises treating the polyester fibre material with a compound of formula (1), wherein $R_1$ is 4-methoxy and $R_2$ is 4-methoxy.

5. A process according to claim 1, which comprises treating the polyester fibre material with a compound of formula (1), wherein $R_3$ is methyl, ethyl or n-butyl.

6. A process according to claim 5, which comprises treating the polyester fibre material with a compound of formula (1), wherein $R_3$ is methyl or n-butyl.

7. A process according to claim 1, which comprises treating the polyester fibre material with a compound of formula (1), wherein $R_4$ is hydrogen.

8. A process according to claim 1, which comprises treating the polyester fibre material with a compound of formula (1), wherein n is 2.

9. A process according to claim 1, which comprises treating the polyester fibre material with a compound of formula (1), wherein n is 1.

10. A process according to claim 1, which comprises treating the polyester fibre material with a compound of formula (1), wherein m is 1.

11. A process according to claim 1, which comprises treating the polyester fibre material with a compound of formula (1), wherein $R_1$ is hydrogen, methyl, methoxy, allyloxy or benzyloxy, $R_2$ is hydrogen, chloro, methoxy, allyloxy or benzyloxy, $R_3$ is methyl, ethyl, i-propyl or n-butyl, and $R_4$ is hydrogen or methyl.

12. A process according to claim 1, which comprises using 0.01 to 5% by weight of the compound of formula (1), based on the weight of the fibre material.

* * * * *